3/27/84 XR 4,438,719

United States Patent [19]

Finsterwalder

[11] 4,438,719

[45] Mar. 27, 1984

[54] CONTAINER FOR TRANSPORTING COMPRESSED GAS, SUCH AS NATURAL GAS, AND METHOD OF CONSTRUCTING THE CONTAINER

[75] Inventor: Ulrich Finsterwalder, Munich, Fed. Rep. of Germany

[73] Assignee: Dyckerhoff & Widmann Aktiengesellschaft, Munich, Fed. Rep. of Germany

[21] Appl. No.: 359,590

[22] Filed: Mar. 18, 1982

[30] Foreign Application Priority Data

Mar. 24, 1981 [DE] Fed. Rep. of Germany ..... 3111408

[51] Int. Cl.[3] ..... B63B 25/08

[52] U.S. Cl. ..... 114/74 A; 220/1 B; 220/71; 220/901; 114/74 R; 114/253; 114/256

[58] Field of Search ..... 114/74 R, 74 A, 242, 114/253, 249, 250, 256; 405/1; 52/600, 663, 81, 245; 220/1 B, 71, 901

[56] References Cited

U.S. PATENT DOCUMENTS

| | | | |
|---|---|---|---|
| 3,016,866 | 1/1962 | Walker | 114/74 A |
| 3,287,864 | 11/1966 | Ulm | 52/81 |
| 3,422,628 | 1/1969 | McDonald | 220/1 B |
| 3,926,134 | 12/1975 | Closner et al. | 114/74 R |
| 4,099,279 | 7/1978 | Park | 405/1 |
| 4,140,073 | 2/1979 | Androulakis | 220/901 |
| 4,181,235 | 1/1980 | Baysinger | 114/74 A |

*Primary Examiner*—Trygve M. Blix
*Assistant Examiner*—Ivy M. Shum
*Attorney, Agent, or Firm*—Toren, McGeady and Stanger

[57] ABSTRACT

A hollow reinforced concrete sphere can be used as a container for transporting compressed gas, such as natural gas. Such containers can be interconnected and towed from one place to another by an ocean-going tugboat. Each container is formed with three band-like groups of reinforcing rings. Each group has its reinforcing rings disposed at right angles to the reinforcing rings in the other groups. The inner and outer surfaces of the container walls can be covered with a desired coating. In constructing the containers, they can be built at the water's edge and then rolled into the water.

13 Claims, 17 Drawing Figures

CONTAINER FOR TRANSPORTING COMPRESSED GAS, SUCH AS NATURAL GAS, AND METHOD OF CONSTRUCTING THE CONTAINER

SUMMARY OF THE INVENTION

The present invention is directed to a container for transporting gas, particularly natural gas, which has been compressed or reduced in volume by pressurization or liquefaction, and also to a method of constructing the container.

In the past, in addition to petroleum, natural gas has become an indispensable source of energy. Unlike petroleum, which is in a viscous liquid form and can be transported in containers or pumped through pipelines, the safe and economical transport of natural gas is subject to considerable risks.

While natural gas can be pumped through pipelines under high pressure without any significant danger, its transportation abroad is both very expensive and risky. It is true that pressurized pipelines have been successfully laid at sea at depths as great as 600 m, the costs have been considerable and the risk of possible damages must be faced in such an operation.

It is also possible to liquefy natural gas at a production site and then to transport it in the liquid state so that its volume is reduced by approximately 1/600th. This method requires, in addition to a liquefaction plant at the production site, specially constructed ships for overseas transportation, special storage containers for liquefied gas, and a gasification plant at the consumption location. In addition to very high investment costs, there is also a safety problem, since, if a container for the liquefied gas develops a leak there is the possibility of the formation of a cloud of gas and air which has a great explosive force if it is ignited.

Therefore, it is the primary object of the present invention to provide a means for transporting natural gas, particularly to an overseas location, in a safe and economical manner.

In accordance with the present invention, a buoyant container is constructed as a hollow solid of rotation having an essentially curved generatrix, preferably in the form of a hollow reinforced concrete sphere.

The outside surface of the container wall can be covered with a liquid-tight coating of a synthetic resin, or the like. The inside surface of the container wall can be covered with a heat-insulating layer of a closed-cell synthetic resin foam, for instance polyurethane foam which can be sprayed continuously in layers. Between the container wall and the heat insulating layer it is useful to provide a vapor-tight layer, such as a layer of epoxy resin, deposited on the inside wall surface with the heat-insulating layer applied directly and adhesively to the vapor-tight layer.

The basic concept of the present invention is to transport compressed natural gas in buoyant, spherically shaped, high pressure reinforced concrete containers, the weight of the containers is supported by their buoyancy. Using such containers, the gas is supplied through a pipeline and pumped into the containers. The containers are transported by an ocean-going tugboat to another location where the gas is to be used and, at that location, the containers discharge the gas directly into another pipeline. Accordingly, liquefaction or gasification plants are not required. Preferably, the steel reinforcement in such containers consists of three band-like groups of rings of reinforcing members. Within each group the rings are disposed in parallel circuits and each ring is self-contained. The band-like groups are positioned at right angles to one another and the width of each of the groups is at least one-quarter of the circumferential length of the ring within the group which has the greatest diameter.

The individual rings of reinforcing members are made up of steel rods or bars with profiled or deformed outside surfaces with the individual bars joined together by connecting elements to form rings. At their ends, the rods can be provided with screw threads and the connecting members can be screw sockets with female screw threads arranged to receive the threaded ends of the bars.

In one preferred embodiment of the invention, the rings of a first group are located in the central portion of the container wall with the rings of the other two groups located in one or more layers inwardly and outwardly of the rings in the first group. It is useful if the diameter of the reinforcing bars of the first group is selected so that the connecting members staggered with regard to their positions in adjacent rings, serve as spacers between adjacent rings.

For structural reasons, a sphere is the most advantageous form for a buoyant high-pressure container. In a sphere, the interior pressure of the compressed gas exerts a uniform tensile stress on the container wall, and the container is not exposed to any significant stresses from the motion of the sea. By arranging the reinforcing members as closed rings of reinforcing elements, with the rings arranged in groups, the tensile stresses acting on the container wall are successfully absorbed without any significant cracks being developed. By utilizing a ballasting portion as a part of the sphere, it is possible to maintain a stable position for the container when it is afloat. The important feature of the invention is the construction of a high-pressure container so that it does not exceed the available draft in most harbors with as large as possible a volume of the gas being transportable in the containers.

In accordance with the present invention, a number of the high pressure containers can be interconnected with one another into an assembly capable of being towed by conventional ocean-going tugs. Such an assembly can be made up of three such containers positioned in a triangular arrangement and interconnected in a bend-resisting manner by cross struts so that the assembly forms a unitary floating body. If the interiors of the containers are in flow connection with one another by flow conduits, all of the containers within an assembly can be filled or emptied in a single work cycle.

It is also possible to transport liquefied gas at correspondingly low temperatures in the containers, if they are provided with an interior heat-insulating layer. With such an arrangement the possibility of damage to the containers while at sea is significantly reduced. A spherically shaped container is substantially less sensitive to external stresses than a ship's hull. The surface of such an assembly exposed to contact with the sea represents only a fraction of the portion of the surface of a tanker in contact with the sea, especially with regard to the cargo held in such different vessels. Compared to a ship's hull, the spherical shape of a container in accordance with the present invention, offers the further advantage that the heat-insulating layer of polyurethane foam, because of the evenness of the spherically shaped surfaces, is exposed to less stress than in a container with corners or edges.

A container constructed in accordance with the present invention is also suitable for the land storage of compressed or liquefied natural gas and correspondingly smaller containers of the same construction can also be used for overland transportation.

In the construction of a container embodying the present invention, initially after the erection of the formwork for the inverted bottom calotte of the container along with the exterior scaffolding, initially the exterior layer of reinforcing members is placed in the lower half of the container, that is, the reinforcing elements which extend vertically. Next, the horizontally extending reinforcing member within the lower part are set in place in the form of closed rings up to approximately the equator of the spherically shaped container. The equator is that plane of the sphere extending perpendicularly of the axis between the poles of the sphere and spaced equidistantly from the poles. Finally, the interior layer of reinforcing members extending in the vertical direction or vertical planes are placed, followed by the construction of the interior formwork for the container. Continuing the placement of the reinforcing members, initially the interior layer of the reinforcing members for the upper part of the container are placed extending in vertical planes upwardly from the interior layer of the reinforcing in the lower part. Next, the intermediate layer is made up of closed reinforcing rings arranged in horizontal planes with the completion of the reinforcing effected by the placement of the exterior layers of the reinforcing members extending in vertical planes and connected with the corresponding vertically arranged reinforcing members in the lower part of the container. Finally, concrete is poured into the formwork to complete the high pressure container with the concrete being placed in one continuous pour.

The reinforcing members of the inner and outer layers are advantageously placed in the form of welded mats. In such an arrangement, the mats of the individual layers can be installed each turned toward one another by approximately one-eighth of a circle in horizontal projection.

After it has been completed, such a container can be launched in the following manner: To start, the container's exterior formwork is constructed on a working surface that slopes gently toward a body of water. After the lower portion of the scaffolding has been partially removed and replaced by a layer of sand, the exterior scaffolding is removed and the container is held in place by cables on the body of sand so that it cannot roll. By cutting the cables securing the container in place, it is automatically set rolling along the sloping surface into the adjacent body of water. In this procedure, by ballasting or weighting the lowest surface of the floating container, the equator of the container, located vertically while the container is being constructed, is automatically rotated into the horizontal position when the container is afloat.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1A:
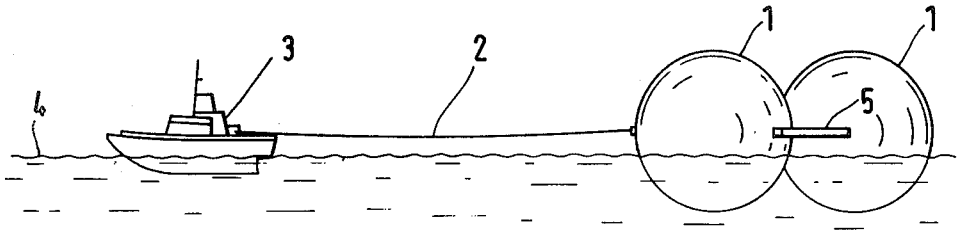
FIG. 1*a* is a schematic side view of a tug pulling three floating containers embodying the present invention.
Figure 1B:
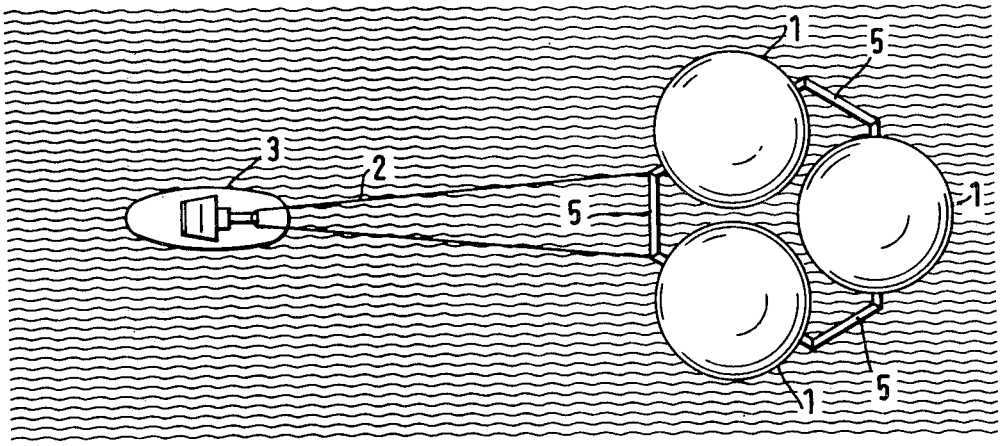
FIG. 1*b* is a plan view of the assembly shown in FIG. 1*a;*

FIG. 1*a* shows a side view and FIG. 1*b* a top view of an assembly of three interconnected floating or buoyant containers 1 being towed on a body of water 4 by an ocean-going tug 3 connected to the assembly by a cable or tow line 2. In the assembly, the containers are interconnected by cross struts 5 located at the level of the equators of the containers.

Figure 2A:
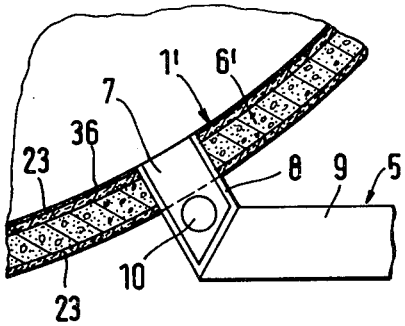
FIG. 2*a* is a sectional view through a container, embodying the present invention, for transporting compressed gas.
Figure 2B:
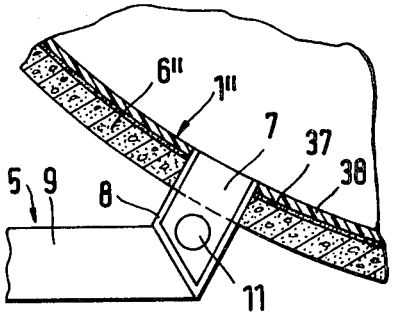
FIG. 2*b* is a sectional view, similar to FIG. 2*a,* through a container, embodying the present invention, for transporting liquefied gas, with a connection shown between the containers of FIGS. 2*a* and 2*b;*

FIGS. 2*a* and 2*b* each illustrate a cutaway portion of a horizontal section through the connection between two containers 1', 1''. For the sake of example, FIG. 2*a* displays a high-pressure container 1' adapted to transport compressed gas, while FIG. 2*b* exhibits a container 1'' adapted to transport liquefied gas. In actual practice, however, these two containers would not be connected to one another.

In FIG. 2*a,* the wall 6' of the container 1' is provided on its inside and outside surfaces with a water-tight layer 23 which ensures the containers required water impermeability. Further, a coating 36 of a synthetic resin, for example, PVC, only about 1 to 2 mm thick, is applied on the inside surface of the layer 23. This layer or coating 36 bridges over any fine cracks in the concrete and serves as additional protection for the reinforcement against corrosion. This construction renders the container 1' suitable for transporting compressed gas.

In FIG. 2*b*, container 1″ is used for transporting liquefied gas and, accordingly, it has a vapor-tight layer 37, for example a layer of an epoxy resin, with a heat-insulating layer 38 deposited on the inside surface of the layer 37. The heat-insulating layer 38 is a polyurethane foam sprayed continuously as several coats on the inside surface of the layer 37. In each of the containers 1′ and 1″ shown in FIGS. 2*a* and 2*b* a steel part is set into and extends outwardly from circular recesses 7 within the walls 6′ and 6″ of the containers.

The steel parts 8 are located at approximately the equator of each of the containers. In one of the parts 8, an aperture 10 serves for the charging and discharging of the gas. In the other container an aperture 11 is provided in the part 8 which serves as an access port into the interior of the container for inspection and maintenance. The aperture 11 can be closed.

Figure 8:
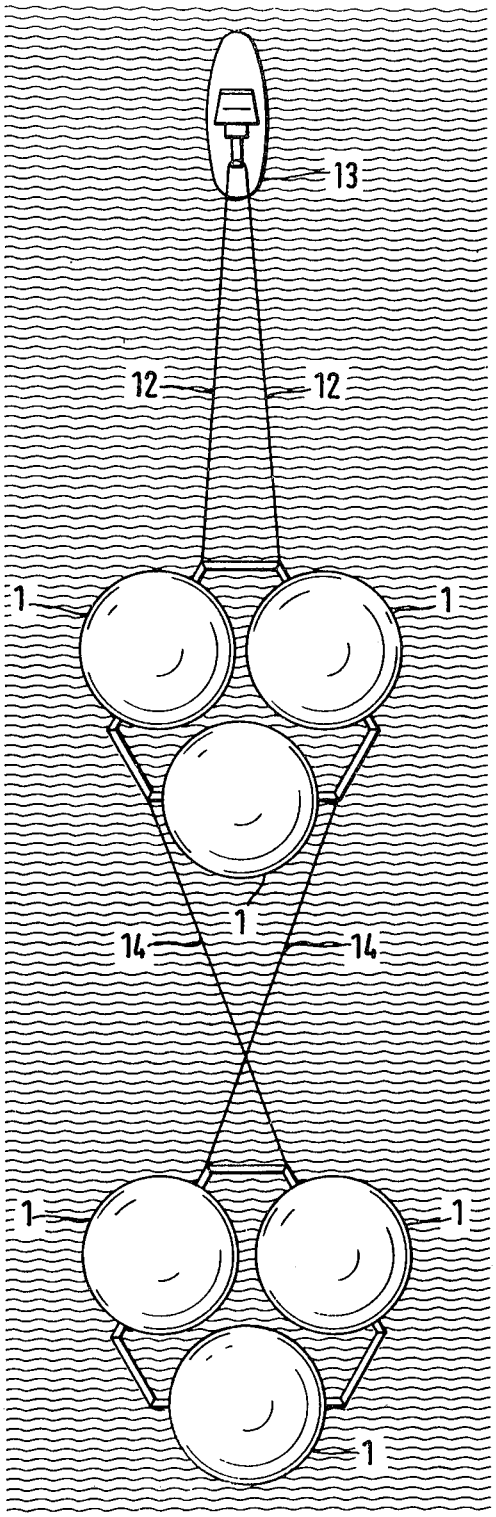
FIG. 8 is a plan view of a tug towing a double assembly of the flowing containers.

In FIG. 1*b* the containers are shown in a triangular arrangement forming an assembly. The interconnection of the containers affords a statically determined bearing and the containers 1 are joined together in a bend-resistant manner so that they can follow the movement of the waves without any development of additional stresses. In FIG. 8 the tug 13 is shown transporting two assemblies of the containers 1, however, it should be appreciated that more than two such assemblies could be transported.

Figure 3:
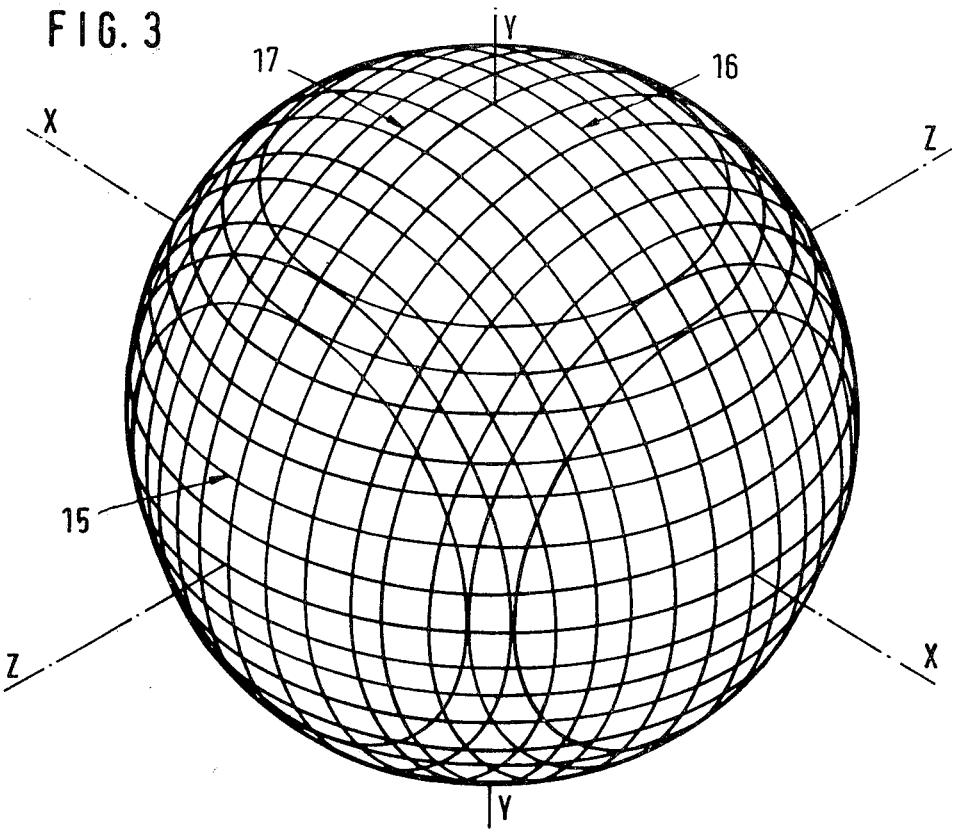
FIG. 3 is a schematic perspective showing the layout of the reinforcing members for a high-pressure container embodying the present invention.

If the containers are used to transport compressed gas, they are reinforced in a conventional manner, that is, the reinforcing is not prestressed. In FIG. 3, the reinforcing members of a high-pressure container 1 are shown schematically in a perspective view. The reinforcing members are divided into three band-like groups of rings with the rings describing parallel circles in spaced relation, with each of the rings being self-contained. Each of the band-like groups intersect the other at right angles, that is, the bands 15 are disposed parallel to the horizontal plane including the X and Z axes, a group 16 extends parallel to a vertical plane including the X and Y axes, and a group 17 extends parallel to the plane containing the Y and Z axes. The width of each of the bands around the circumference of the sphere is somewhat greater than one-fourth of the sphere circumference, accordingly, the groups at right angles to one another intersect approximately at the quarter points of the sphere, that is, approximately midway between the equator and the poles of the sphere. In such an arrangement, the reinforcing members are distributed uniformly throughout the wall of the sphere so that it has a dense filling of the reinforcing steel.

Figure 4:
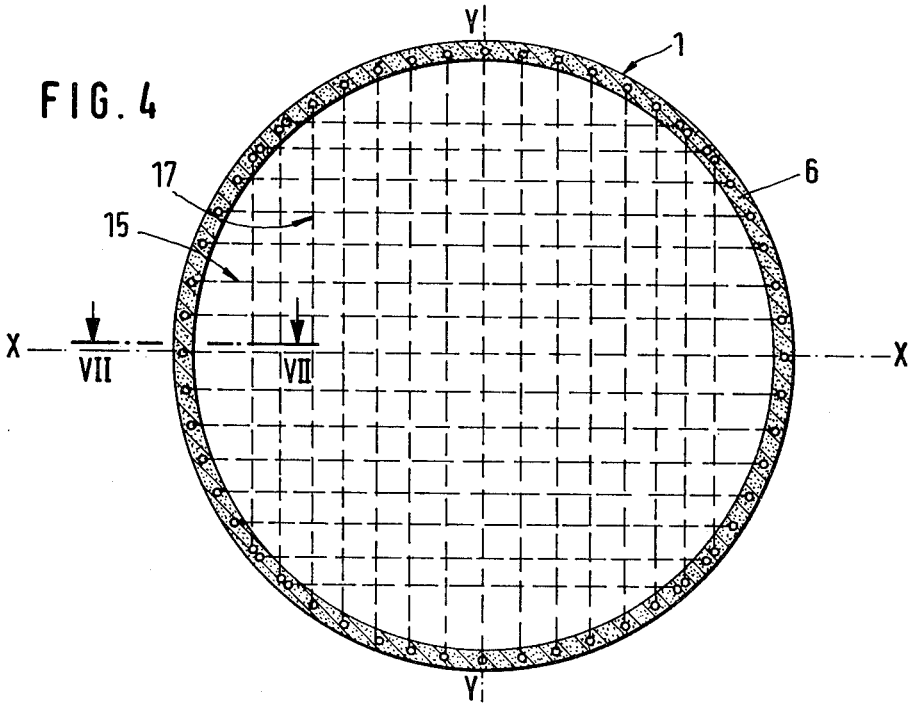
FIG. 4 is a vertical sectional view of the arrangement shown in FIG. 3.
Figure 5:
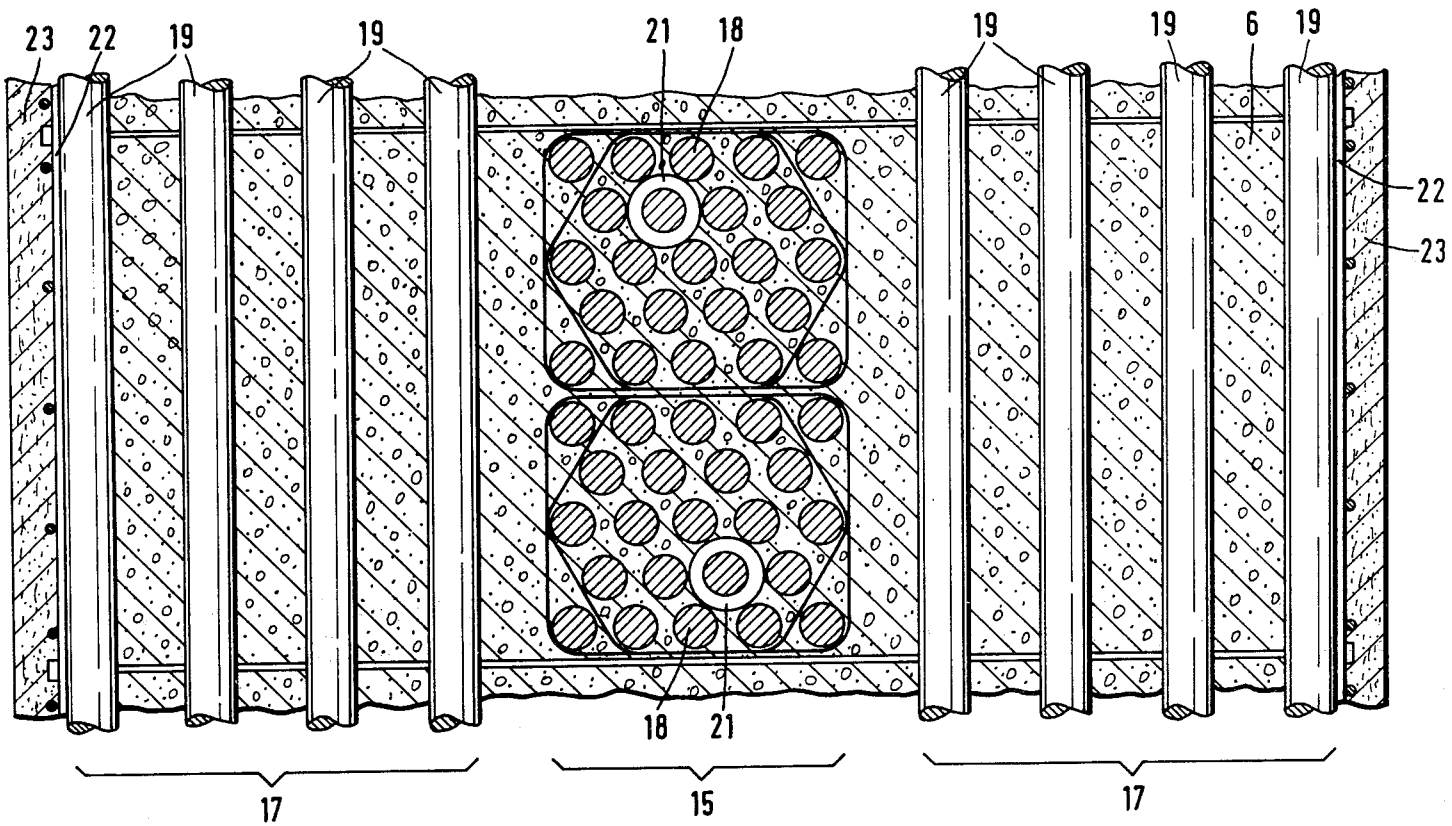
FIG. 5 is an enlarged detail view of a vertical section through the wall of a container embodying the present invention, with the section taken at the equator of the spherical container.
Figure 7:
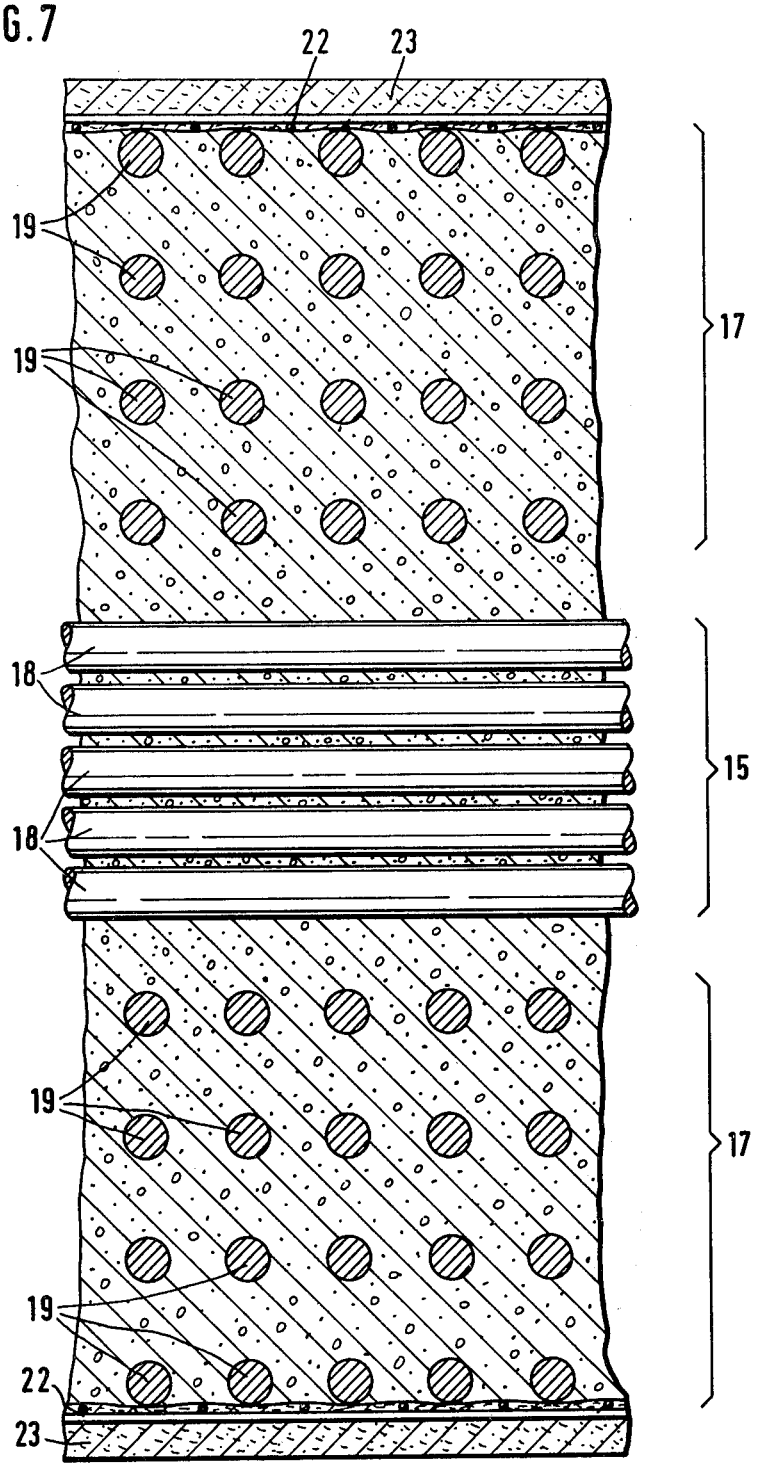
FIG. 7 is an enlarged horizontal sectional view through the wall of a container embodying the present invention.

FIGS. 5 and 7 show the arrangement of the reinforcing steel on corresponding portions of a vertical section (FIG. 5) and a horizontal section (FIG. 7) in the region of the equator of the container disclosed in FIG. 4. As illustrated, the reinforcing members extending horizontally, that is the reinforcing rings of the group 15 (FIG. 3) are located in the middle portion of the wall 6 and are made up of a number of closely spaced steel rods 18. The reinforcing members extending in vertical planes, that is the group 17 (FIG. 3) is in the form of individual steel rods 19 positioned symmetrically on the opposite sides of the horizontal reinforcing members 18. The steel rods 19 are positioned between the steel rods 18 and the inside and outside surfaces of the container wall.

Figure 6:
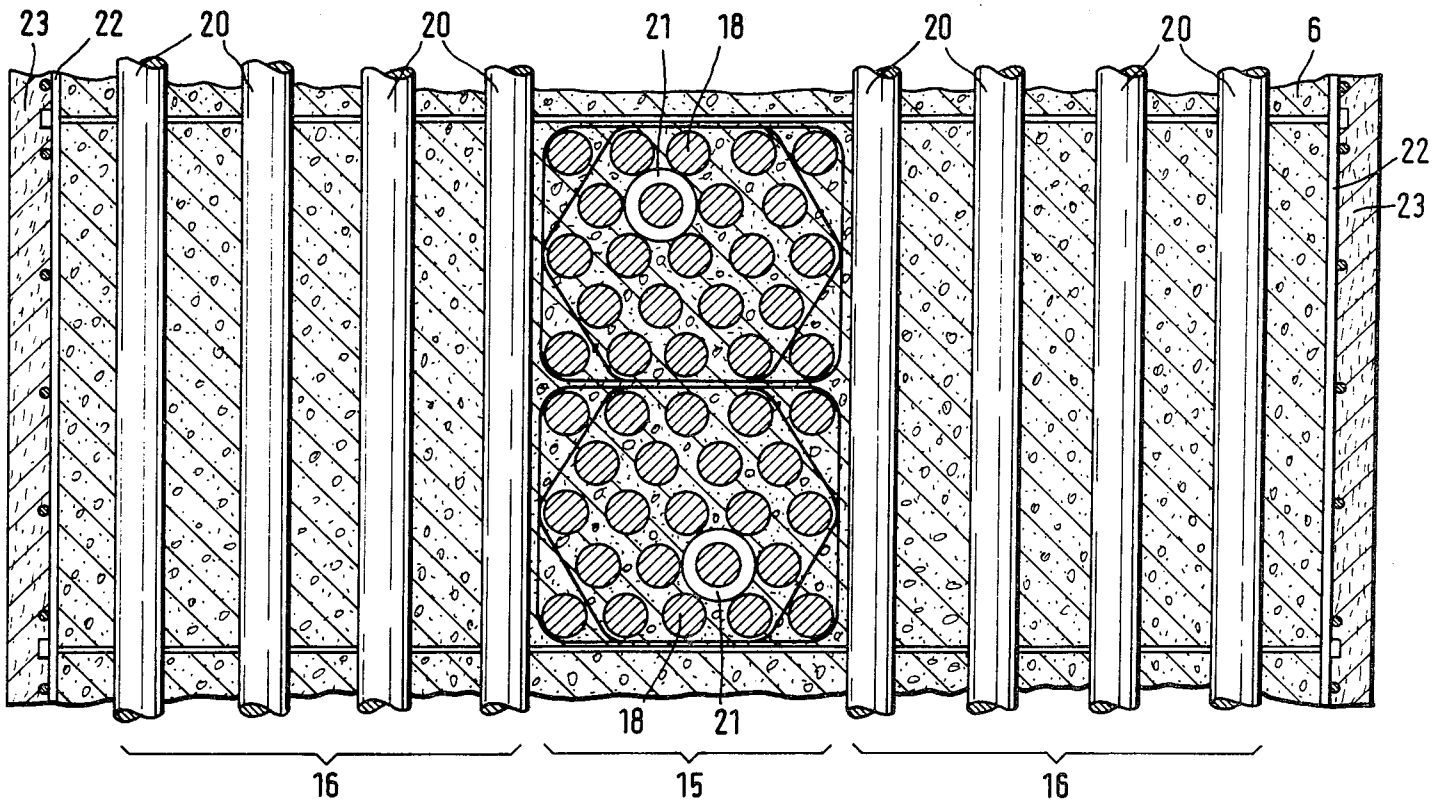
FIG. 6 is a view similar to that shown at FIG. 5, rotated 90° about the vertical axis y-y of the container.

FIG. 6 is a vertical section, corresponding to FIG. 5, in a position rotated 90° about the Y axis. In this figure, the group 16 has vertically extending laterally spaced steel rods 20 located between the horizontally extending rods 18 and the inside and outside surfaces of the container wall.

The horizontally disposed steel rods 18 are interconnected by sockets 21 to form the complete reinforcing rings. The rods 18 are held together to form bundles and when a container is being constructed, these bundles can be lifted at the construction site by a suitable lifting apparatus.

In constructing a container in accordance with the present invention, a lattice-like formwork, known per se, and formed of a close-mesh wire netting 25 is used as shown in FIGS. 5 to 7. A watertight coating 23 is deposited on the inside and outside surfaces of the wall enclosing the lattice-like formwork 22 to assure that the container is adequately watertight. Further, a 1 to 2 mm thick layer of a synthetic resin, such as PVC, can be sprayed on the inner surface of the coating 23. This layer of synthetic resin protects the reinforcement against rust and bridges over hairline cracks.

A feature of considerable economical importance is the use of high-grade steels having a strength three times greater than conventional reinforcing steel rated at 2400 kp/cm$^2$. The high strength steel can be of the type used for threading tools. By using such high strength reinforcing with steel rods of 16 mm diameter, approximately 25 hairline cracks with a mean width of 0.14 mm appear per meter. Such cracks do not impair the rust protection of the reinforcing steel. Using the containers of the present invention, transportation costs are reduced by approximately 60%, since a greater quantity of gas can be carried corresponding to the higher strength steel than would be possible in a similar container using conventional reinforcing steel.

Figure 9A:
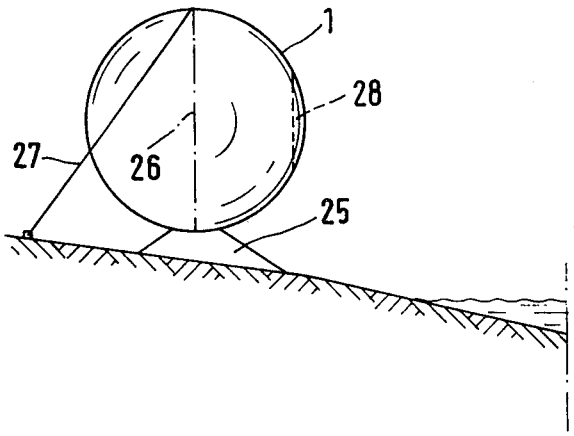
FIGS. 9*a* and 9*b* are side views of a container showing, respectively, the container at the land base construction site and the container afloat in a body of water adjacent to the construction site.
Figure 9B:
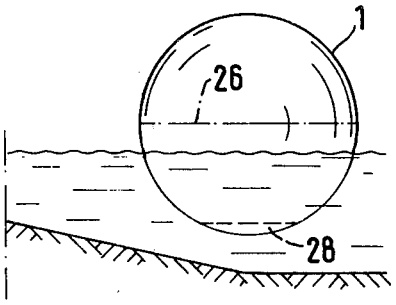
Figure 10A:
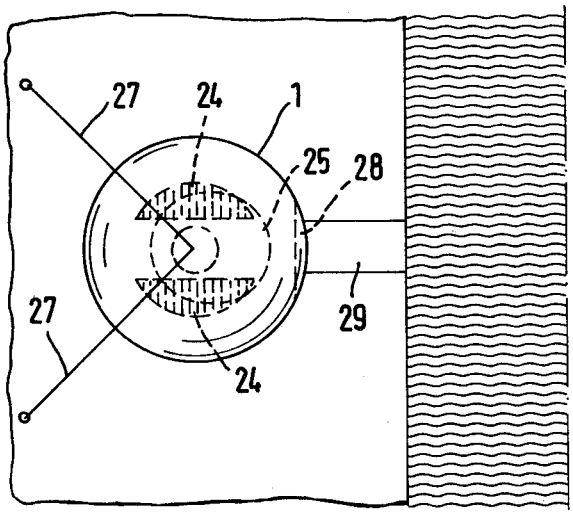
FIGS. 10*a* and 10*b* are plan views of the two positions of the container shown in FIGS. 9*a* and 9*b.
Figure 10B:
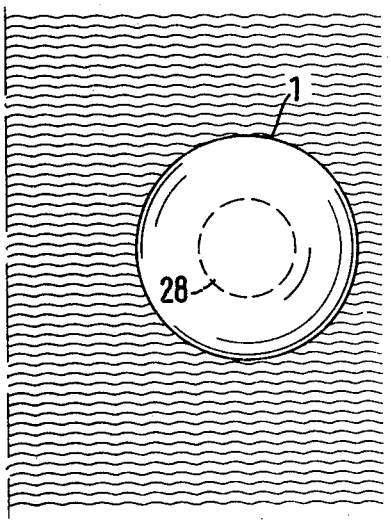

FIGS. 9*a*, 9*b*, 10*a* and 10*b* illustrate the launching procedure according to the present invention with the container being shown in side view and plan view at the construction site, FIGS. 9*a* and 10*a*, and floating in the water adjacent the construction site, FIGS. 9*b* and 10*b*.

In FIGS. 9*a* and 10*a* the container is resting on a layer or bed of sand 25 with only a portion of the lower scaffolding 24 shown in position, note FIG. 10*a*. As constructed, the equator plane 26 of the container is positioned vertically. The container 1 is held in the position of FIGS. 9*a* and 10*a* by guying members 27.

At the lowermost point of the container 1 when it is in the floating position, a ballast 28 is provided, such as by an increased thickening of the reinforced concrete wall of the container.

After the cables 27 securing the container in position, have been cut or released, because of the position of the ballast 28, note FIG. 9*a*, almost automatically the container starts to roll down the slope into the water. A bed of sand 29 extends from the construction position shown in FIGS. 9*a*, 10*a* down to the water so that the container plows a track for itself as it rolls downwardly. This type of construction does not require any expensive equipment, such as a construction dock, which could be very costly because of the necessary water depth. Using this construction procedure affords inexpensive mass production and assures the desired success of the method embodied in the invention.

Figure 11A:
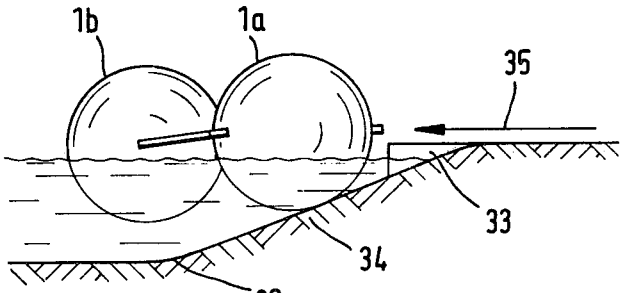
* and FIGS. 11*a,* 11*b* and 11*c* represent a side view, a top view and a front view of an arrangement for loading and unloading an assembly of containers at a location along the edge of a body of water.
Figure 11C:
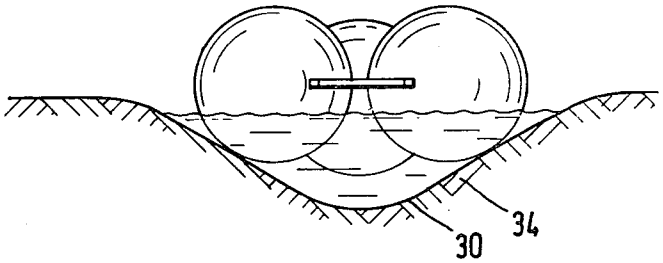
Figure 11B:
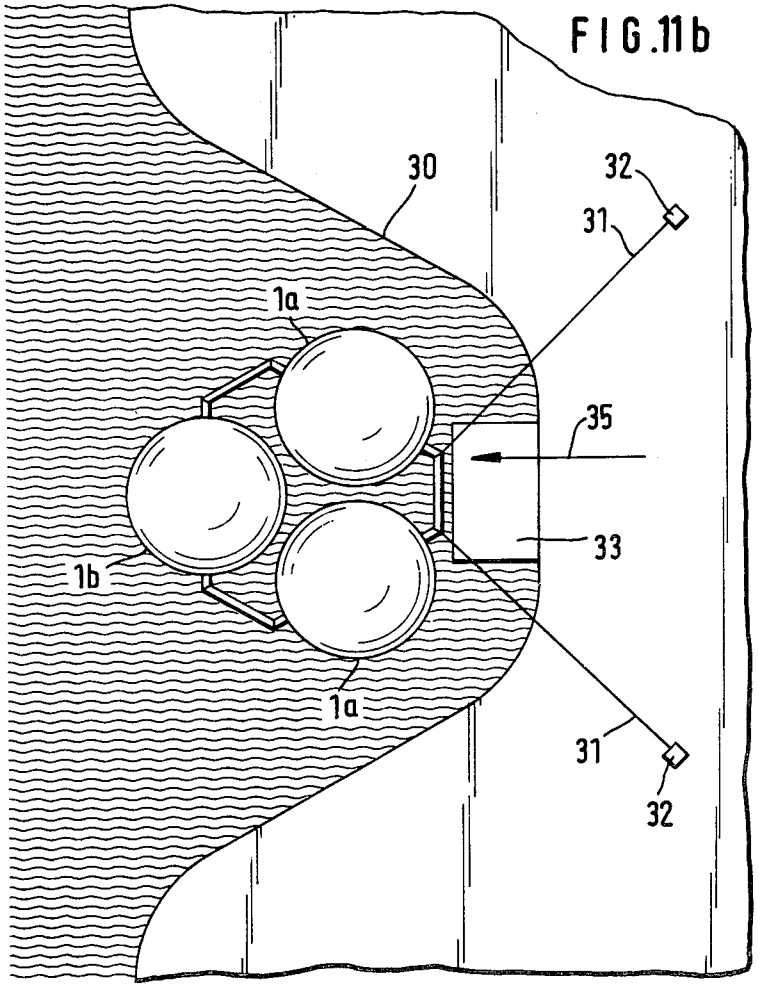

In FIGS. 11*a*, 11*b* and 11*c* a side view, a top view and a front view are shown, respectively, of the assembly made up of three containers 1*a*, 1*a* and 1*b*. These containers can be loaded and unloaded in a basin-like bay along the coastline. The three-container assembly is secured at a landing 33 by means of cables 31. The cables 31 can be tightened by winches 32. To achieve a position unaffected by possible fluctuations in the water level, the two containers 1*a* closer to the landing 33 rest on the floor of the bay. Note the manner in which the floor slopes in FIGS. 11*a* and 11*c*. The container 1*b* more remote from the landing 33 floats in the water and is spaced upwardly from the bay floor. Accordingly, the container 1*b* adjusts itself to changing water levels. A gas supply or removal conduit 35 is located at the landing 33.

While specific embodiments of the invention have been shown and described in detail to illustrate the application of the invention principles, it will be understood that the invention may be embodied otherwise without departing from such principles.

I claim:

1. Device for transporting gas, such as natural gas, which has been reduced in volume, such as by one of pressurization and liquefaction, comprising a buoyant hollow container in the form of a solid of rotation with a curved generatrix, said hollow container is a hollow sphere formed of reinforced concrete, a wall forms said container having an outside surface and an inside surface with at least a watertight coating deposited on the outside surface, three band-like groups of reinforcing members are positioned in said wall for reinforcing said container, each of said groups comprises a plurality of rings disposed in spaced parallel relation with the rings in each said group intersecting the rings in the other said groups at right angles, said groups comprise a first said group, a second said group and a third said group, said first group located in the middle region of said wall of said container and said second and third groups are arranged at a number of locations inwardly and outwardly of said first group.

2. Device, as set forth in claim 1, wherein each of said rings forming said group comprises steel rods the diameter of said rods forming said rings of said first group and the diameter of said connecting elements are sized and said connecting elements are staggered relative to one another on adjacent said rings so that said connecting elements serve as spacers spacing the adjacent said rings from said ring on which said connecting elements are located.

3. Device, as set forth in claim 1, wherein said watertight coating is formed of a synthetic resin.

4. Device, as set forth in claim 3, wherein a heat insulating layer of a closed-cell synthetic resin foam is applied to the inside surface of said wall of said container.

5. Device, as set forth in claim 4, wherein said heat-insulating layer is formed of a polyurethane foam.

6. Device, as set forth in claim 4 or 5, wherein a vapor-tight layer is formed on the inside surface of said wall of said container between said wall and said heat-insulating layer.

7. Device, as set forth in claim 6, wherein said vapor-tight layer is formed of an epoxy resin.

8. Device, as set forth in claim 1, wherein the width of each said band measured around the circumference of said container is equal to at least one-quarter of the length of the one of said rings forming said group which has the greatest diameter.

9. Device, as set forth in claim 8, wherein each of said rings forming said groups comprise steel rods with deformed surfaces and connecting elements fitted onto said steel rods and in combination with said steel rods forming said rings.

10. Device, as set forth in claim 9 or 2, wherein the ends of said rods are threaded and said connecting elements are screw sockets with interior screw threads so that the screw sockets can be threaded onto said rods.

11. Device, as set forth in claim 1, wherein three said containers are disposed in a horizontal triangular arrangement with cross struts extending between adjacent said containers joining said containers together in a bend-resistant assembly.

12. Device, as set forth in claim 11, wherein said cross struts extend between the equator planes of said containers.

13. Device, as set forth in claim 11 or 12 wherein the ends of said cross struts connected to said containers have closable openings therein for providing loading and unloading of said containers and for affording access to the interior of said containers.

* * * * *